United States Patent [19]

Sonoda et al.

[11] Patent Number: 4,976,242

[45] Date of Patent: Dec. 11, 1990

[54] FUEL INJECTION CONTROL DEVICE OF AN ENGINE

[75] Inventors: Yukihiro Sonoda; Kouichi Osawa; Hiroshi Kanai; Kouichi Hoshi; Hiroki Matsuoka, all of Susono; Michihiro Ohashi, Mishima; Hiroshi Sawada, Gotenba, all of Japan

[73] Assignee: Toyota Jidosha Kabushiki Kaisha, Toyota, Japan

[21] Appl. No.: 469,297

[22] Filed: Jan. 24, 1990

[30] Foreign Application Priority Data

Jan. 27, 1989 [JP] Japan ..... 1-16347

[51] Int. Cl.[5] ..... F02D 41/10; F02D 41/12; F02D 41/14

[52] U.S. Cl. ..... 123/489; 123/492; 123/493

[58] Field of Search ..... 123/440, 489, 492, 493

[56] References Cited

U.S. PATENT DOCUMENTS

| | | | |
|---|---|---|---|
| 4,416,237 | 11/1983 | Aoki et al. | 123/438 |
| 4,499,882 | 2/1985 | Saito et al. | 123/492 |
| 4,616,619 | 10/1986 | Saito et al. | 123/492 |
| 4,633,840 | 1/1987 | Saito et al. | 123/492 |
| 4,635,200 | 1/1987 | Egami et al. | 123/492 |
| 4,913,120 | 4/1990 | Fujimoto et al. | 123/492 X |

FOREIGN PATENT DOCUMENTS

| | | |
|---|---|---|
| 57-18440 | 1/1982 | Japan . |
| 58-104335 | 6/1983 | Japan . |
| 58-104336 | 6/1983 | Japan . |
| 60-1346 | 1/1985 | Japan . |
| 60-17237 | 1/1985 | Japan . |
| 60-116836 | 6/1985 | Japan . |

*Primary Examiner*—Tony M. Argenbright
*Attorney, Agent, or Firm*—Kenyon & Kenyon

[57] ABSTRACT

A fuel injection control device in which it is determined whether the air-fuel mixture is lean or rich at a predetermined crankangle during a lean-rich discriminating time at the time of acceleration. The lean-rich discriminating time is shortened as the degree of the acceleration becomes larger, and the times of being lean and the times of being rich within the lean-rich discriminating time are calculated. When the times of being lean are larger than the times of being rich, and the difference therebetween is larger than a predetermined value, the accelerating increasing rate of the amount of fuel fed into the engine cylinder is increased.

29 Claims, 14 Drawing Sheets

Fig. 8a
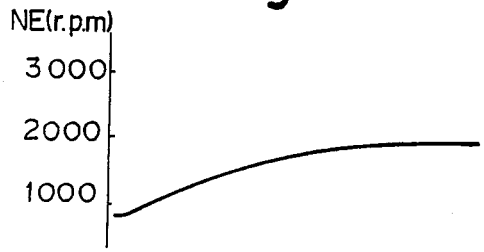
Fig. 8b
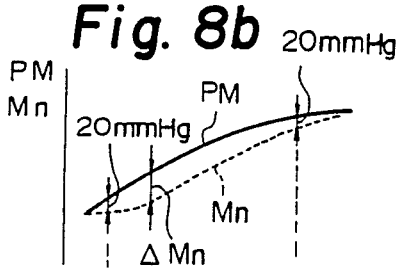
Fig. 8c
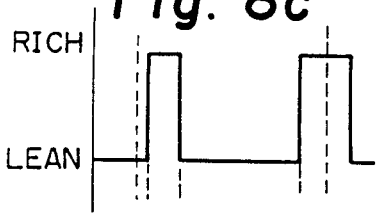
Fig. 8d
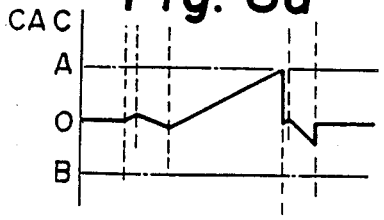
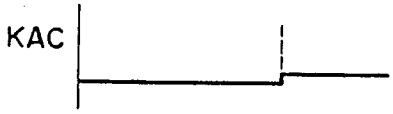
Fig. 8e
Fig. 8f
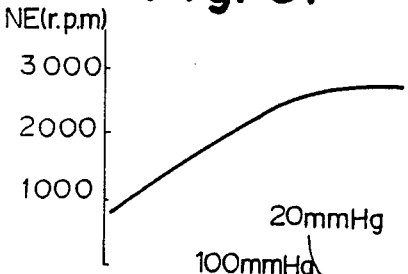
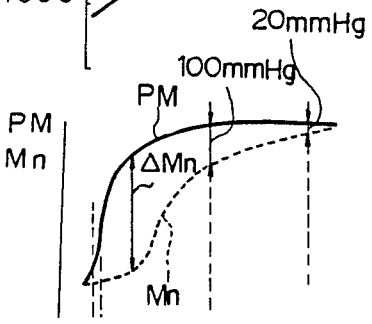
Fig. 8g
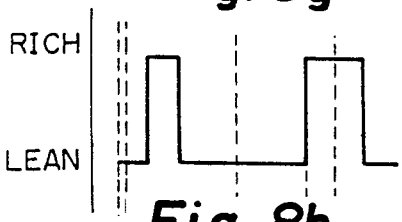
Fig. 8h
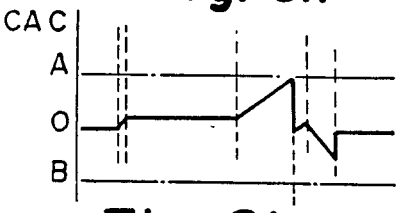
Fig. 8i
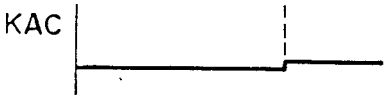
Fig. 8j

TO A ROUTINE FOR CALCULATING THE FUEL INJECTION TIME

FUEL INJECTION CONTROL DEVICE OF AN ENGINE

BACKGROUND OF THE INVENTION

1. Field of the Invention

The present invention relates to a fuel injection control device of an engine.

2. Description of the Related Art

In a fuel injection type engine, the basic amount of fuel injected by a fuel injector is usually calculated from the engine speed and the level of vacuum in the intake passage, or from the engine speed and the amount of air fed into the engine cylinder, and the actual amount of fuel injected by the fuel injector is feedback controlled so that the air-fuel ratio of the mixture fed into the engine cylinder becomes equal to a predetermined desired air-fuel ratio, for example, the stoichiometric air-fuel ratio, by correcting the basic amount of fuel on the basis of the output signal of the oxygen concentration detector (hereinafter referred to as an $O_2$ sensor) arranged in the exhaust passage of the engine. Nevertheless, even if such a feedback control is carried out, when the amount of fuel injected by the fuel injector is abruptly increased as at the time of acceleration, the amount of fuel adhering to the inner wall of the intake port in the form of a liquid fuel is increased, and since this liquid fuel is not fed into the engine cylinder immediately after adhering to the inner wall of the intake port, the air-fuel mixture fed into the engine cylinder temporarily becomes lean. Conversely, when the engine is decelerated, absolute pressure in the intake port becomes low, and as a result, since the amount of vaporization of the liquid fuel adhering to the inner wall of the intake port is increased, the air-fuel mixture fed into the engine cylinder temporarily becomes rich.

Consequently, in a fuel injection type engine, the amount of fuel injected by the fuel injector is usually increased at the time of an acceleration and decreased at the time of a deceleration, so that the air-fuel ratio of the mixture fed into the engine cylinder becomes equal to a desired air-fuel ratio, for example, the stoichiometric air-fuel ratio, even if the engine is operating in a transition state such as an acceleration state and a deceleration state. Consequently, in such a fuel injector type engine, the air-fuel ratio of the mixture fed into the engine cylinder is controlled so that it becomes approximately equal to the desired air-fuel ratio, regardless of the operating state of the engine.

Nevertheless, in such a fuel injection type engine, blowby gas and lubricating oil, for example, pass through the clearance between the valve stem and the stem guide of the intake valve and flow into the intake port, and thus, when the engine is run for a long time, carbon particles, etc., contained in the blowby gas and the lubricating oil are gradually deposited on the inner wall of the intake port and the rear face of the valve head of the intake valve. These deposited carbon particles, i.e., the carbon deposit, have a physical characteristic of retaining liquid fuel, and thus, if the carbon deposit is deposited on the inner wall of the intake port, etc., the amount of liquid fuel adhering to the inner wall of the intake port, etc. is increased, and this increases the time taken by the liquid fuel to flow into the engine cylinder after the liquid fuel adheres to the inner wall of the intake port, etc. Consequently, although the air-fuel ratio of mixture fed into the engine cylinder can be controlled so that it becomes approximately equal to the stoichiometric air-fuel ratio, regardless of the engine operating state, while the engine is relatively new, if the deposit is deposited on the inner wall of the intake port, etc., after the engine has been run for a long time, since the time taken by the liquid fuel to flow into the engine cylinder is increased, as mentioned above, the air-fuel mixture fed into the engine cylinder becomes lean at the time of acceleration. In addition, since the amount of the liquid fuel adhering to the inner wall of the intake port, etc. is increased, the air-fuel mixture fed into the engine cylinder becomes rich at the time of deceleration. At this time, the air-fuel mixture becomes leaner as the amount of the deposit is increased at the time of acceleration, and the air-fuel mixture becomes richer as the amount of the deposit is increased at the time of deceleration.

Consequently, in a fuel injection control device disclosed in Japanese Patent Application No. 63-16275, when the accelerating operation of the engine is carried out, it is determined whether or not the air-fuel mixture fed into the engine cylinder is lean or rich at a predetermined crankangle, and the times of being lean and the times of being rich are calculated. Then the difference between the times of being lean and the times of being rich is calculated, and if the times of being lean are larger than the times of being rich, and the above-mentioned difference exceeds a predetermined time, it is determined that the air-fuel mixture is lean, and the amount of fuel fed into the engine cylinder is corrected and increased.

As mentioned above, if the deposit is adhered to the inner wall of the intake port, etc., the air-fuel mixture becomes lean at the time of acceleration. At this time, the time during which the air-fuel mixture becomes lean, i.e., the lean time, is almost the same, regardless of whether an abrupt accelerating operation or a gentle accelerating operation of the engine is carried out. But where it is determined whether the air-fuel mixture is lean or rich at a predetermined crankangle as mentioned above, since the engine speed abruptly becomes high when the abrupt accelerating operation of the engine is carried out, the times of the determination of whether the air-fuel mixture is lean or rich per unit of time are increased. As a result, when the abrupt accelerating operation is carried out, the times at which it is determined that the air-fuel mixture is lean are considerably increased, compared with the case wherein a gentle accelerating operation is carried out. Namely, when the abrupt accelerating operation is carried out, the difference between the times of being lean and the times of being rich is considerably increased, compared with the case wherein the gentle accelerating operation is carried out. Consequently, if the above-mentioned predetermined times for the difference are lowered to detect the lean state at the time of the gentle accelerating operation, a problem occurs in that this will cause a wrong determination that the air-fuel mixture is lean at the time of the abrupt accelerating operation, even though the actual air-fuel mixture has not become lean. Conversely, if the above-mentioned predetermined times are increased to detect the lean state at the time of the abrupt accelerating operation, a problem occurs in that this causes a wrong determination that the air-fuel mixture is not lean at the time of the gentle accelerating operation, even though the actual air-fuel mixture has become lean.

SUMMARY OF THE INVENTION

Therefore, an object of the present invention is to provide a fuel injection control device capable of correctly determining that the air-fuel mixture has actually become lean, regardless of whether the abrupt accelerating operation or the gentle accelerating operation is carried out.

According to the present invention, there is provided a fuel injection control device of an engine having an intake passage and an exhaust passage, the device comprising: an oxygen concentration detector arranged in the exhaust passage and producing an output signal indicating whether an air-fuel mixture fed into the engine is lean or rich; feedback control means for controlling an amount of fuel fed into the engine in response to the output signal of the oxygen concentration detector to bring an air-fuel ratio of the mixture to a desired air-fuel ratio; means for detecting an accelerating operation of the engine; fuel increasing means for increasing the amount of fuel fed into the engine when the accelerating operation of the engine is carried out; times calculation means determining, on the basis of the output signal of the oxygen concentration detector, whether the air-fuel mixture is lean or rich at a predetermined crankangle during a lean-rich discriminating time when the accelerating operation of the engine is carried out, to calculate both times of being lean and the times of being rich within the lean-rich discriminating time; time control means for controlling the lean-rich discriminating time in response to a degree of an acceleration of the engine, to shorten the lean-rich discriminating time as the degree of the acceleration of the engine becomes larger; means for calculating a difference between the times of being lean and the times of being rich; and correction means for correcting an increase in the amount of fuel, which increase is caused by the fuel increasing means, to increase the increase in the amount of fuel when the times of being lean is larger than the times of being rich and when the difference is larger than a predetermined value, and to reduce the increase in the amount of fuel when the times of being rich is larger than the times of being lean and when the difference is larger than a predetermined value.

The present invention may be more fully understood from the description of preferred embodiments of the invention set forth below, together with the accompanying drawings.

BRIEF DESCRIPTION OF THE DRAWINGS

In the drawings:

FIGS. 8(*a*)–(*j*) are time charts of an embodiment, illustrating a method of calculating the deposit learning coefficient;

DESCRIPTION OF PREFERRED EMBODIMENTS

Figure 1:
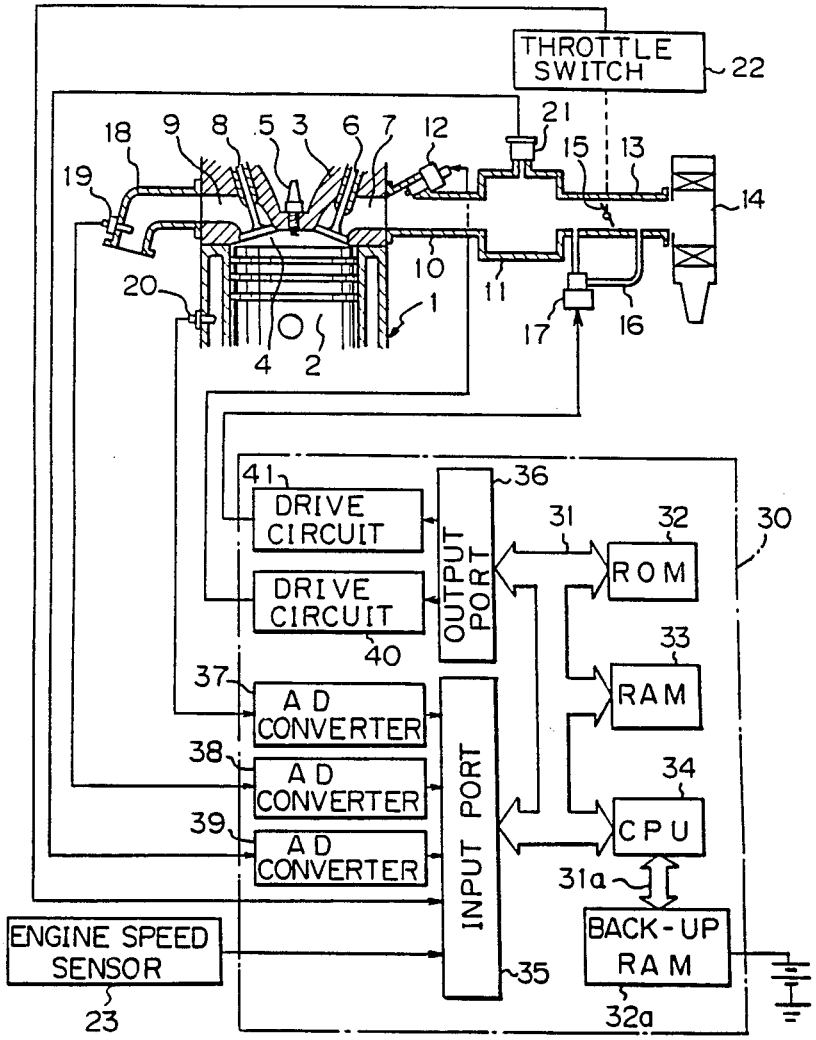
FIG. 1 is a schematically illustrated view of an engine.

Referring to FIG. 1, reference numeral 1 designates an engine body, 2 a piston, 3 a cylinder head, and 4 a combustion chamber formed between the piston 2 and the cylinder head 3; 5 designates a spark plug, 6 an intake valve, 7 an intake port, 8 an exhaust valve, and 9 an exhaust port. The intake port 7 is connected to a surge tank 11 via a corresponding branch pipe 10, and a fuel injector 12 is mounted on the branch pipe 10 to inject fuel into the corresponding intake port 7. The fuel injecting operation by the fuel injector 12 is controlled by a signal output by an electronic control unit 30. The surge tank 11 is connected to an air cleaner 14 via an intake duct 13, and a throttle valve 15 is arranged in the intake duct 13. A bypass passage 16 bypassing the throttle valve 15 is connected to the intake duct 13, and a bypass air control valve 17 is arranged in the bypass passage 16. The exhaust port 9 is connected to an exhaust manifold 18, and an $O_2$ sensor 19 is arranged in the exhaust manifold 18.

The electronic control unit 30 is constructed as a digital computer and comprises a ROM (read only memory) 32, a RAM (random access memory) 33, a CPU (microprocessor etc.) 34, an input port 35, and an output port 36. The ROM 32, the RAM 33, the CPU 34, the input port 35 and the output port 36 are interconnected via a bidirectional bus 31. A back-up RAM 32*a* is connected to the CPU 34 via a bus 31*a*.

A coolant temperature sensor 20 producing an output voltage proportional to the engine cooling water temperature is mounted on the engine body 1, and the output voltage of the coolant temperature sensor 20 is input to the input port 35 via an AD converter 37. The output voltage of the $O_2$ sensor 19 is also input to the input port 35 via an AD converter 38. An absolute pressure sensor 21 producing an output voltage proportional to the absolute pressure in the surge tank 11 is arranged in the surge tank 11, and the output voltage of the absolute pressure sensor 21 is input to the input port 35 via an AD converter 39. A throttle switch 22 is attached to the throttle valve 15, to detect that the throttle valve 15 is fully closed, and the output signal of the throttle switch 22 is input to the input port 35. An engine speed sensor 23 produces an output pulse each time the crankshaft (not shown) is rotated by a predetermined crankangle, and the output pulse of the engine speed sensor 23 is input to the input port 35. The engine speed is calculated from this output pulse, in the CPU 34. The output port 36 is connected to the fuel injector 12 and the bypass air control valve 17 via corresponding drive circuits 40 and 41. The bypass air control valve 17 is provided for controlling the idling speed of the engine, and the amount of the bypass air flowing within the bypass passage 16 is controlled by the bypass air control valve 17 so that the engine speed becomes equal to a desired idling speed at the time of idling.

The fuel injection time TAU of the fuel injector 12 is calculated from the following equation.

$$TAU=(TP+KAC.TPAEW).FAF.F \quad (1)$$

Where

TP: basic fuel injection time

TPAEW: correction fuel injection time for the transition state such as an accelerating state and a decelerating state KAC: correction coefficient of the correction fuel injection time TPAEW for the deposit FAF: feedback correction coefficient F: correction coefficient determined by the temperature of the engine cooling water and the temperature of air fed into the engine cylinder etc.

The basic fuel injection time TP is calculated from the engine speed NE and the absolute pressure PM in the surge tank 11. The relationship among the basic fuel injection time TP, the absolute pressure PM, and the engine speed NE is experimentally determined so that the air-fuel ratio of the fuel and air mixture fed into the engine cylinder becomes equal to a desired air-fuel ratio, for example, the stoichiometric air-fuel ratio, when fuel is injected from the fuel injector 12 for the basic fuel injection time TP during a cruising operating state of the engine, and this relationship is stored in the ROM 32. Consequently, when the cruising operation of the engine is carried out, if fuel is injected from the fuel injector 12 for the basic fuel injection time TP, which is calculated on the basis of the relationship, stored in the ROM 32, between the absolute pressure PM and the engine speed NE, the air-fuel ratio of the mixture fed into the engine cylinder becomes essentially approximately equal to the desired air-fuel ratio. At this time, if the $O_2$ sensor 19 which can detect any air-fuel ratio is used, it is possible to freely use any air-fuel ratio as the desired air-fuel ratio. Nevertheless, the present invention will be hereinafter described with regard to the case where the desired air-fuel ratio is the stoichiometric air-fuel ratio, so that the present invention can be easily understood. In this case, if fuel is injected from the fuel injector 12 for the basic fuel injection time TP, the air-fuel ratio of mixture fed into the engine cylinder becomes essentially approximately equal to the stoichiometric air-fuel ratio.

When the engine operating state is not a transition state, i.e., when the cruising operation of the engine is carried out, the correction fuel injection time TPEAW becomes equal to zero. Consequently, at this time, the above-mentioned equation (1) can be represented as follows.

$$TAU=TP.FAF.F \quad (2)$$

Namely, at this time, the fuel injection time TAU is determined by the basic fuel injection time TP, the feedback correction coefficient FAF, and the correction coefficient F. In this case, the correction coefficient F is determined by the temperature of the engine cooling water and the temperature of air fed into the engine cylinder, etc. For example, this correction coefficient F becomes more than 1.0 before the completion of a warm-up period of the engine, wherein the cooling water temperature is low, and this correction coefficient F becomes equal to 1.0 or nearly 1.0 after the completion of a warm-up of the engine. In addition, the feedback correction coefficient FAF changes in response to the output signal of the $O_2$ sensor 19, so that the air-fuel ratio of mixture fed into the engine cylinder becomes equal to the stoichiometric air-fuel ratio.

Next, the feedback correction coefficient FAF will be described.

The $O_2$ sensor 19 produces an output voltage of about 0.1 volt when the air-fuel ratio of the mixture fed into the engine cylinder is higher than the stoichiometric air-fuel ratio, i.e., when the air-fuel mixture is lean, and the $O_2$ sensor 19 produces an output voltage of about 0.9 volt when the air-fuel ratio of the mixture is lower than the stoichiometric air-fuel ratio, i.e., when the air-fuel mixture is rich. Consequently, it can be determined, on the basis of the output signal of the $O_2$ sensor 19, whether the air-fuel mixture is lean or rich.

Figure 2:
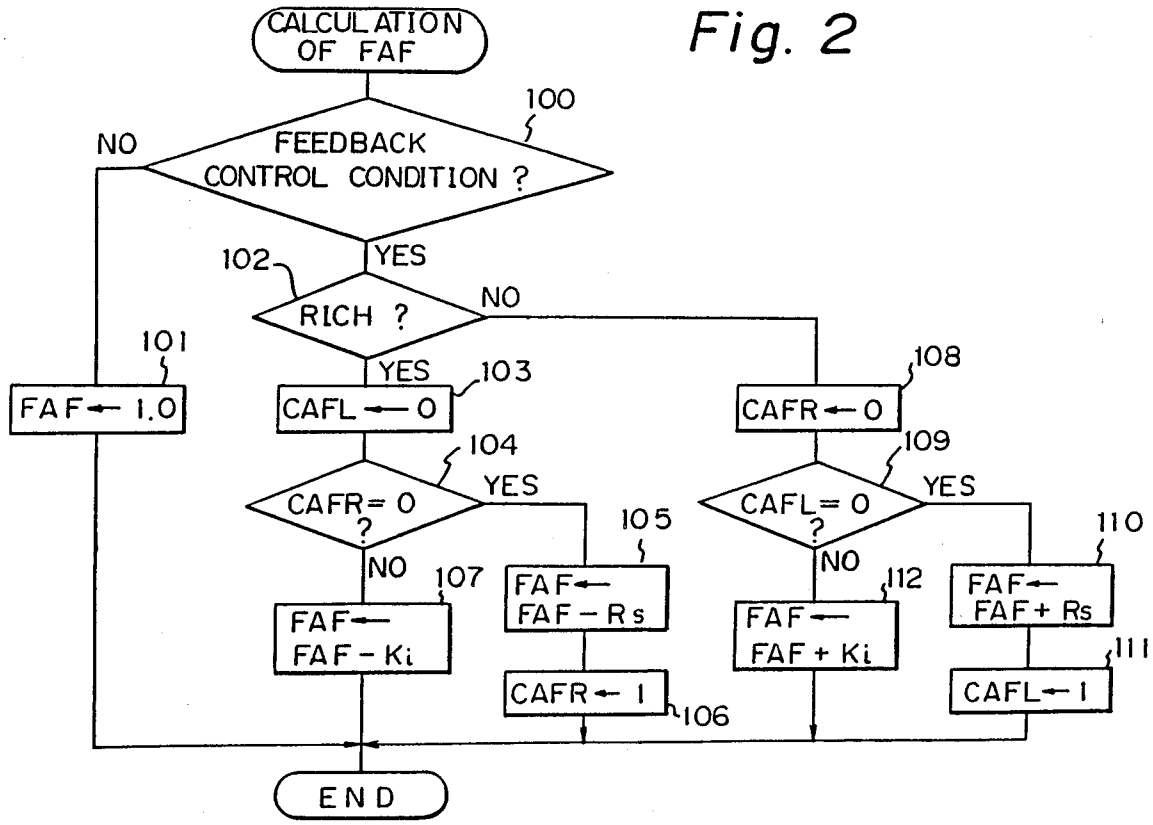
FIG. 2 is a flow chart for calculating the feedback correction coefficient FAF.

FIG. 2 illustrates a routine for calculating the feedback correction coefficient FAF on the basis of the signal output by the $O_2$ sensor 19.

Figure 3:
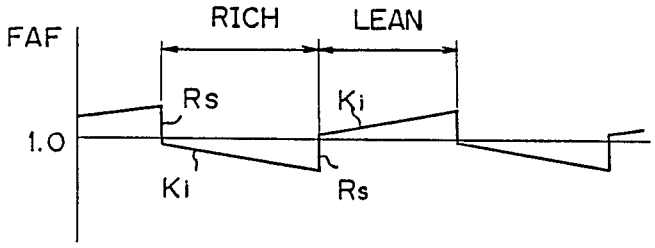
FIG. 3 is a diagram illustrating a change in the feedback correction coefficient FAF.

Referring to FIG. 3, in step 100 it is determined whether or not the feedback control condition is satisfied. It is determined that the feedback control condition is satisfied when the operating state of the engine is not an engine starting state and when the temperature of the engine cooling water is higher than a predetermined temperature. When the feedback control condition is not satisfied, the routine goes to step 101 and the feedback control coefficient FAF becomes 1.0. Consequently, when the feedback control condition is not satisfied and when the cruising operation of the engine is carried out, the fuel injection time is calculated from the following equation.

$$TAU=TP.F$$

When it is determined that the feedback control condition is satisfied, the routine goes to step 102 and it is determined, on the basis of the $O_2$ sensor 19, whether or not the air-fuel mixture fed into the engine cylinder is rich. If the air-fuel mixture was lean in the preceding processing cycle, and if the air-fuel mixture becomes rich in the present processing cycle, the routine goes to step 103 and the flag CAFL is reset. Then, in step 104 it is determined whether or not the flag CAFR, which is reset when the air-fuel mixture changes from rich to lean, has been reset. When the air-fuel mixture changes from lean to rich, since the flag CAFR has been reset, the routine goes to step 105 and a predetermined skip value Rs is subtracted from the feedback control coefficient FAF. Then, in step 106 the flag CAFR is set. Consequently, in the next processing cycle, the routine goes from step 104 to step 107 and a predetermined fixed value Ki ($Ki << Rs$) is subtracted from the feedback correction coefficient FAF.

When the air-fuel mixture changes from rich to lean, the routine goes to step 108, and the flag CAFR is reset. Then, in step 109 it is determined whether or not the flag CAFL has been reset. At this time, since the flag CAFL has been reset, the routine goes to step 110, and the predetermined skip value Rs is added to the feedback control coefficient FAF. Then, in step 111 the flag CAFL is set. Consequently, in the next processing cycle, the routine goes from step 109 to step 112 and the predetermined fixed value Ki is added to the feedback correction coefficient FAF. Consequently, the feedback correction coefficient FAF changes as illustrated in FIG. 3. When the air-fuel mixture becomes rich, since the feedback control coefficient FAF becomes small, the fuel injection time TAU becomes short. Conversely, when the air-fuel mixture becomes lean, since the feedback control coefficient FAF becomes large, the fuel injection time TAU becomes long. Thus, the air-fuel ratio of the mixture is controlled so that it becomes equal to the stoichiometric air-fuel ratio.

As mentioned above, when the cruising operation of the engine is carried out, and when the feedback control of the air-fuel ratio is carried out, the air-fuel ratio of the mixture fed into the engine cylinder is controlled so that it becomes equal to the stoichiometric air-fuel ratio. Where the fuel injection time TAU is calculated by using the above-mentioned equation (2), however, when the operating state of the engine is a transition state, such as an acceleration state and a deceleration state, the air-fuel ratio of the mixture deviates from the stoichiometric air-fuel ratio even if the feedback control is carried out and even if a deposit is not adhered to the inner wall of the intake port, etc. Namely, when the engine is accelerated the air-fuel mixture temporarily becomes lean, and when the engine is decelerated the air-fuel mixture temporarily becomes rich. Such a deviation of the air-fuel ratio occurring at the time of a transition state of the engine is based on the time lag until the fuel injecting operation is actually carried out after the calculation of the fuel injection time TAU is started, on the time lag due to a hereinafter described blunt value of the absolute pressure PM, and on the time lag until the liquid fuel adhering to the inner wall of the intake port, etc., flows into the engine cylinder. These time lags, generated at the time of acceleration, will now with reference to FIGS. 4 and 5.

Figure 4A:
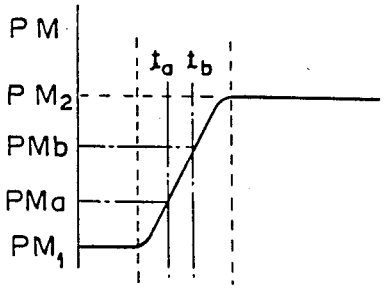
FIGS. 4(*a*)–(*c*) are diagrams illustrating the deviation of the air-fuel ratio caused by the delay time of the actual injection.
Figure 4B:
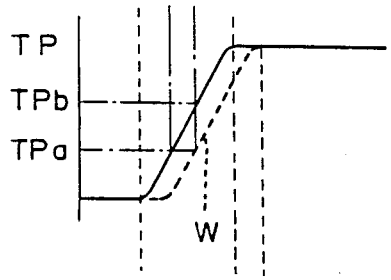
Figure 4C:
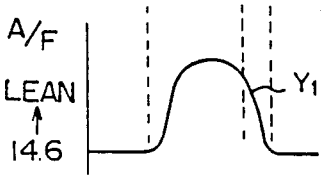
Figure 5A:
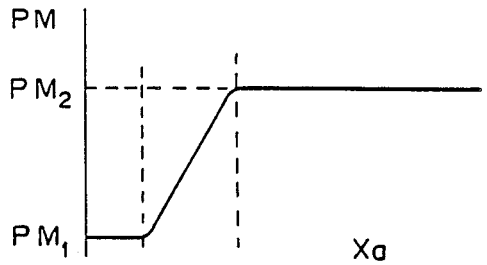
FIGS. 5(*a*)–(*d*) are diagrams illustrating the deviation of the air-fuel ratio caused by the delay time of the actual inflow of fuel into the engine cylinder.
Figure 5B:
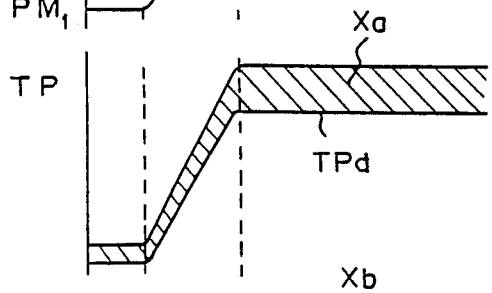
Figure 5C:
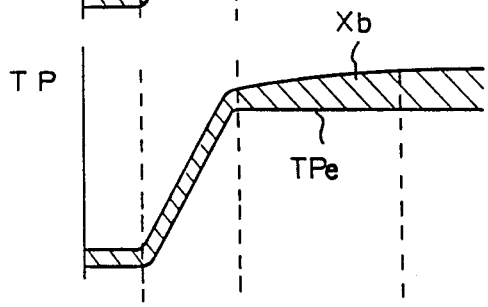
Figure 5D:
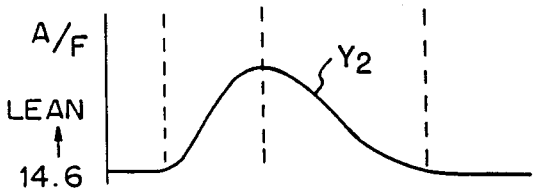

FIGS. 4(*a*)–(*c*) illustrates the deviation of the air-fuel ratio based on the time lag until the fuel injecting operation is actually carried out after the calculation of the fuel injection time TAU is started, and on the time lag due to the blunt value of the absolute pressure PM. As illustrated in FIGS. 4(*a*)–(*c*), if the engine is accelerated, and thus the absolute pressure PM in the surge tank 11 is increased from $PM_1$ to $PM_2$, the basic fuel injection time TP calculated from the absolute pressure PM and the engine speed NE is increased accordingly. Assuming that the calculation of the fuel injection time TAU is started at a time $t_a$, and that the absolute pressure PM at this time is equal to PMa, the basic fuel injection time TP is calculated based on the blunt value PMc obtained by blunting the change in the absolute pressure PM. At this time, the basic fuel injection time TP becomes equal to TPc, which is shorter than the TPa necessary for bringing the air-fuel ratio of the mixture to the stoichiometric air-fuel ratio.

The calculation of the fuel injection time TAU is usually started at a predetermined crankangle, and after the crankshaft has rotated through the predetermined angle, the actual fuel injecting operation is started. Namely, in FIGS. 4(*a*)–(*c*), if the calculation of the fuel injection time TAU is started at a time $t_a$, the actual fuel injection is started at a time $t_b$. At the time $t_b$, however, the absolute pressure PM is increased to PMb, which is higher than PMc, and thus the basic fuel injection time TPb, which is necessary for equalizing the air-fuel ratio of the mixture with the stoichiometric air-fuel ratio at the time $t_b$, becomes longer than the basic fuel injection time TPc. Nevertheless, in the time $t_b$, since fuel is injected by only the time calculated based on the basic fuel injection TPc, the amount of fuel actually injected by the fuel injector 12 becomes smaller than the amount of fuel necessary for equalizing the air-fuel ratio of the mixture with the stoichiometric air-fuel ratio, and thus the air-fuel mixture becomes lean. Namely, in practice, since the basic fuel injection time TP changes along the broken line W in FIG. 4(*b*) the air-fuel mixture becomes lean, as illustrated by $Y_1$ in FIG. 4(*c*), during the time illustrated by the broken line W.

FIGS. 5(*a*)–(*d*) illustrate the deviation of the air-fuel ratio based on the time lag until the liquid fuel adhering to the inner wall of the intake port, etc. flows into the engine cylinder. FIGS. 5(*a*)–(*d*) also illustrate the case where the absolute pressure PM is increased from $PM_1$ to $PM_2$. In FIGS. 5(*a*)–(*d*), the curved lines TPc and TPd indicate a change in the basic fuel injection time TP, and the hatching Xa and Xb indicates the amount of liquid fuel flowing into the engine cylinder, which depends on the amount of fuel injected by the fuel injector 12, i.e., on the amount of liquid fuel adhering to the inner wall of the intake port, etc., and the amount of liquid fuel flowing into the engine cylinder is increased as the amount of fuel injected by the fuel injector 12 is increased, when the cruising operation of the engine is carried out, the amount of liquid fuel flowing into the engine cylinder is maintained at an approximately constant value, and at this time, the amount of liquid fuel flowing into the engine cylinder is increased as the engine load becomes higher. The hatching Xa illustrates the case wherein it is assumed that the amount of fuel flowing into the engine cylinder at each absolute pressure PM is the same as that when the cruising operation of the engine is carried out. In this case, also at the time of acceleration, the air-fuel ratio of the mixture fed into the engine cylinder is maintained at the stoichiometric air-fuel ratio. In practice however, when the accelerating operation of the engine is carried out, even if the amount of liquid fuel adhering to the inner wall of the intake port, etc., is increased, since all of the liquid fuel does not immediately flow into the engine cylinder, the amount of liquid fuel flowing to the engine cylinder at the time of acceleration becomes smaller than that illustrated by the hatching Xa. As the amount of liquid fuel adhering to the inner wall of the intake port, etc., is increased, the amount of liquid fuel flowing into the engine cylinder is gradually increased, and after the completion of the accelerating operation of the engine, the amount of liquid fuel flowing into the engine cylinder becomes equal to that during the cruising operation of the engine. The hatching Xb indicates the amount of liquid fuel which actually flows into the engine cylinder. Consequently, as can be seen from FIGS. 5(*a*)–(*d*), the amount of liquid fuel Xb flowing into the engine cylinder becomes smaller than the amount of liquid fuel Xa flowing during the cruising operation of the engine, until some time has elapsed after the completion of the accelerating operation of the engine, and consequently, during this time, the air-fuel mixture becomes lean as illustrated by $Y_2$.

Therefore, at the of acceleration, as illustrated by Y in FIG. 6(*b*), the shape of the lean curve is formed by superposing the lean curve $Y_1$ on the lean curve $Y_2$. Accordingly, as illustrated in FIG. 6(*c*), if the amount of fuel injected by the fuel injector 12 is increased by an amount $C_2.\Delta PM.C_4$ which corresponds to the lean curve $Y_1$, and at the same time, as illustrated by FIG. 6(*d*), if the amount of fuel injected by the fuel injector 12 is increased by an amount $C_3.(\Delta PM+C_1.\Delta PM).C_4$ which corresponds to the lean curve $Y_2$, the air-fuel mixture is maintained at approximately the stoichiometric air-fuel ratio as illustrated by Z, as illustrated by FIG. 6(*e*). In the above-mentioned amounts corresponding to the lean curves $Y_1$ and $Y_2$ as illustrated by FIG. 6(*a*), ΔPM indicates a rate of change of the blunt value of the absolute pressure PM, and $C_4$ indicates a coefficient for converting the absolute pressure PM to time.

Namely, in FIGS. 4(*a*)–(*c*), the shortage (TPb - TPa) of the basic fuel injection time TP is approximately equal to a value obtained by multiplying the time $(t_b - t_a)$ by $\Delta PM.C_4$ which is at $t_a$, and if the time $(t_b - t_a)$ is represented by $C_2$, the shortage of the basic fuel injection time TP can be represented as $C_2.\Delta PM.C_4$. In this case, since the time $(t_b - t_a)$ corresponds to the rotation angle of the crankshaft, $C_2$ is a function of the engine speed NE.

The curved line corresponding to the line curve $Y_2$ can be represented by $C_3.(\Delta P+C_1\Sigma\Delta PM).C_4$. Note, $C_1$ denotes an attenuation coefficient and is smaller than 1.0. This $C_3.(\Delta P+C_1\Sigma\Delta PM).C_4$ is calculated when calculating the fuel injection time TAU. The value of $C_3.(\Delta P+C_1\Sigma\Delta PM).C_4$ is rapidly increased when ΔPM is large, and the value of $C_3.(\Delta P+C_1\Sigma\Delta PM).C_4$ is gradually reduced when ΔPM becomes small. When the engine temperature or the temperature of air fed into the engine cylinder becomes low, the amount of liquid fuel adhering to the inner wall of the intake port, etc., is increased, and accordingly, the air-fuel mixture becomes leaner. Consequently, $C_3$ is a function of both the engine temperature and the temperature of air fed into the engine cylinder.

Therefore, if the amount of fuel injected by the fuel injector 12 is increased by an amount equal to the sum of $C_2.\Delta PM.C_4$ and $C_3.(\Delta PM+C_1\Sigma\Delta PM).C_4$ at the time of acceleration, the air-fuel mixture can be maintained at the stoichiometric air-fuel ratio. This amount of fuel to be increased at the time of acceleration represents the correction fuel injection time TPAEW in the above-mentioned equation (1), and thus TPAEW is represented as follows.

$$TPAEW=\{C_2.\Delta PM+C_3.(\Delta PM+C_1\Sigma\Delta M)\}.C_4 \quad (3)$$

In addition, where the fuel injection time TAU is calculated based on the above-mentioned equation (2), at the time of deceleration, the air-fuel mixture becomes rich and changes along the rich curves similar to the lean curves $Y_1$ and $Y_2$ illustrated in FIGS. 4(*c*) and 5(*d*). Consequently, at this time, if using TPAEW shown in the above-mentioned equation (3) during the calculation of the fuel injection time TAU, the air-fuel mixture fed into the engine cylinder is maintained at the stoichiometric air-fuel ratio. At this time, however, since ΔPM becomes negative, TPAEW also becomes negative.

Consequently, where carbon is not deposited on the inner wall of the intake port, etc., if the fuel injection time TAU is calculated by the following equation, it is possible to maintain the air-fuel mixture at the stoichiometric air-fuel ratio, regardless of the operating state of the engine.

$$TAU=(TP+TPAEW).FAF.F \quad (4)$$

Nevertheless, when the engine has been used for a long time, and thus a carbon deposit is adhered to the inner wall of the intake port, etc., since this deposit has a physical characteristic of retaining liquid fuel, the amount of liquid fuel adhering to the inner wall of the intake port, etc., is increased, and thus the time required for the liquid fuel to flow into the engine cylinder is increased. Consequently, where the deposit is adhered to the inner wall of the intake port, etc., if the above-mentioned equation (4) is used to calculate the fuel injection time TAU, the air-fuel mixture will deviate from the stoichiometric air-fuel ratio. Namely, at the time of acceleration, since the inflow of liquid fuel to the engine cylinder is delayed due to the presence of the deposit, the air-fuel mixture becomes lean, and at the time of deceleration, since the amount of liquid fuel adhering to the inner wall of the intake port, etc., is increased due to the presence of the deposit, the air-fuel mixture becomes rich.

Therefore, to maintain the air-fuel ratio of mixture at the stoichiometric air-fuel ratio even if the deposit is adhered to the inner wall of the intake port, etc., the correction fuel injection time TPAEW is multiplied by the correction coefficient KAC, and an increase or a decrease in the amount of fuel injected by the fuel injector 12 at the time of acceleration or deceleration, respectively, is corrected by the correction coefficient KAC. In this case, as indicated by the above-mentioned equation (1), the fuel injection time TAU is calculated from the following equation.

$$TAU=(TP+KAC.TPAEW).FAF.F$$

Namely, when a deposit is not adhered to the inner wall of the intake port, etc., and thus the air-fuel ratio of mixture is maintained at the stoichiometric air-fuel ratio even when the accelerating operation of the engine is carried our as illustrated in FIGS. 7(*a*)–(*c*), the lean state and the rich state of the air-fuel mixture is alternately repeated at almost the same time frequency, after the accelerating operation of the engine is started. Consequently, at this time, the lean time and the rich time become almost the same. Conversely, if the deposit is adhered to the inner wall of the intake port, etc., as illustrated in FIGS. 7(*d*)–(*f*), the air-fuel mixture temporarily becomes lean at the time of acceleration, and as a result as illustrated by FIGS. 7(*d*)–(*f*), the lean time after the start of acceleration becomes longer than the rich time. Conversely, if the air-fuel mixture temporarily becomes rich at the time of acceleration, the rich time after the start of acceleration becomes longer than the lean time. Therefore, by comparing the lean time with the rich time, it is possible to determine whether or not the air-fuel mixture is temporarily lean or rich.

Therefore, generally, if the lean time becomes longer than the rich time, and the difference between the lean time and the rich time exceeds a fixed time at the time of acceleration, the correction coefficient KAC is increased, and thus an acceleration increasing ratio of the amount of fuel is increased. Conversely, if the rich time becomes longer than the lean time, and the difference between the rich time and the lean time exceeds a fixed time at the time of acceleration, the correction coefficient KAC is decreased, and thus the acceleration increasing ratio of the amount of fuel is decreased.

On the other hand, if the correction coefficient KAC is increased, a decelerating reducing rate of the amount of fuel is increased, and if the correction coefficient KAC is decreased, the decelerating reducing rate of the amount of fuel is decreased.

Next, the routine for calculating the correction coefficient KAC, i.e., the deposit learning coefficient KAC, will be described on the basis of the flow chart illustrated in FIGS. 9 and 10 with reference to the time charts illustrated in FIGS. 8(*a*)-(*j*). This routine is processed by sequential interruptions which are executed at every crankangle of 360°.

Figure 9:
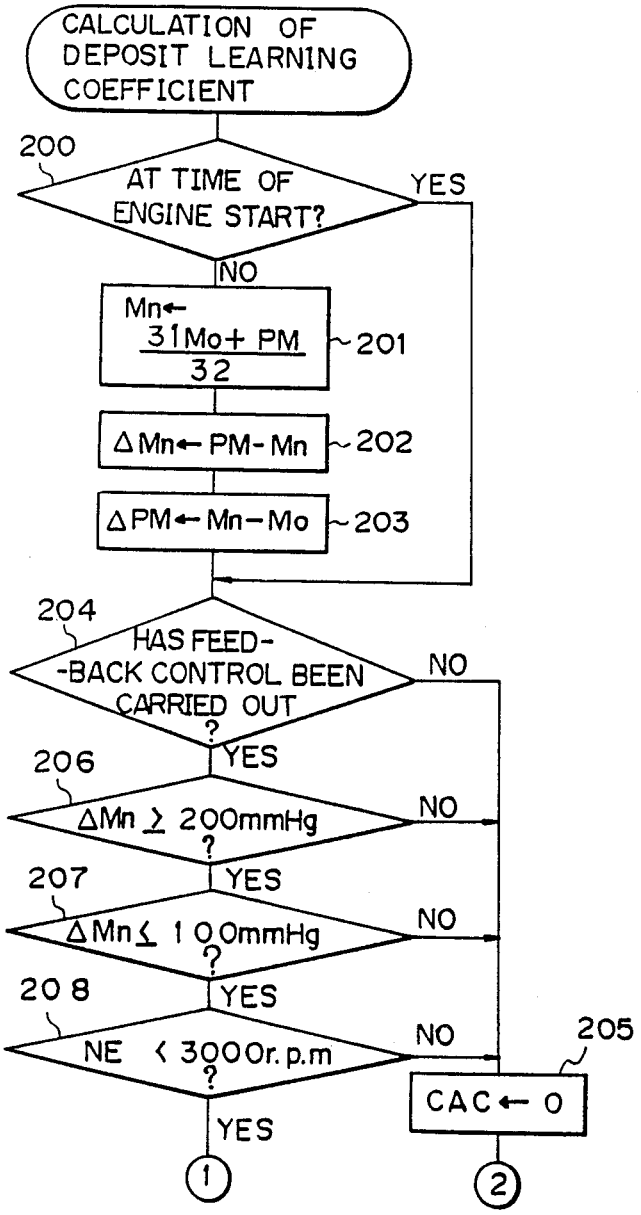
FIGS. 9 and 10 are a flow chart for calculating the deposit learning coefficient by the method illustrated in FIG. 8.
Figure 10:
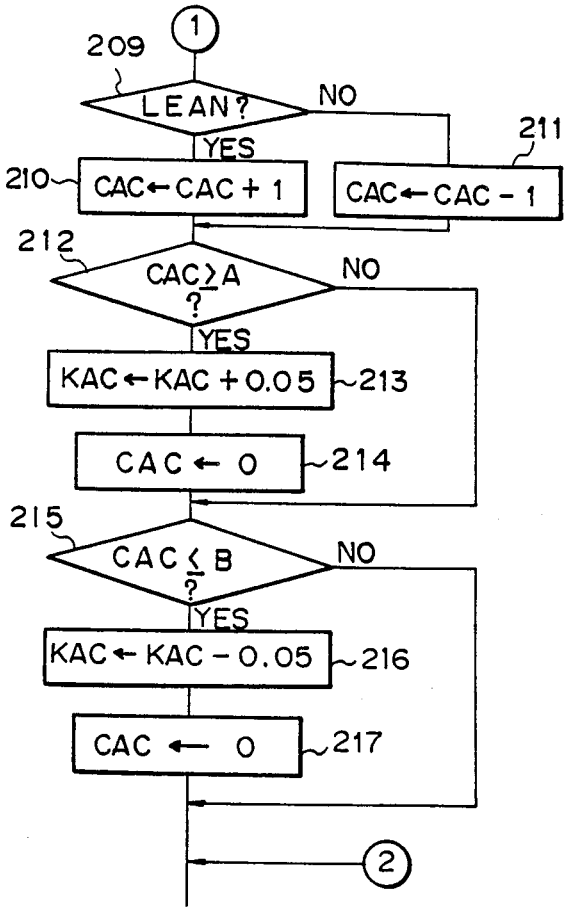

Referring to FIGS. 9 and 10, in step 200 it is determined whether or not the starting operation of the engine has been carried out, for example, the engine speed NE is lower than 400 r.p.m. If the starting operation of the engine has been carried out, the routine jumps to step 204 and it is determined, on the basis of the output signal of the $O_2$ sensor 19, whether or not the feedback control of the air-fuel ratio has been carried out. When the starting operation of the engine has been carried out, since the feedback control has not been carried out, the routine goes to step 205, and in step 205, the counter CAC is cleared and the routine then goes to a routine for calculating the fuel injection time.

Conversely, if the engine operating state is not an engine starting state, the routine goes from step 200 to step 201, and the following blunt value Mn of the absolute pressure PM is calculated on the basis of the output signal of the absolute pressure 21.

$$Mn=(31\ Mo+PM)/32$$

In this equation, PM indicates the present absolute pressure in the surge tank 11, and Mo indicates the blunt valve Mn in the preceding processing cycle. This blunt valve Mn is used for eliminating the influence on the detection of the real absolute pressure PM of pressure fluctuations caused by air pulsations in the intake passage.

Then in step 202 the blunt value Mn is subtracted from the present absolute pressure PM, and the result of the subtraction is memorized as ΔMn, and in step 203 the blunt value Mo in the preceding processing cycle is subtracted from the present blunt value Mn and the result of the subtraction is memorized as ΔPM. Then the routine goes to step 204.

In step 204, if it is determined that the feedback control is carried out, the routine goes to step 206 and it is determined whether or not ΔMn is larger than a predetermined fixed value, for example, 20 mmHg. If $\Delta Mn<20$ mmHg, the routine goes to step 205 and the counter CAC is cleared. Conversely, if $\Delta Mn\geqq 20$ mmHg, the routine goes to step 207 and it is determined whether or not ΔMn is smaller than a predetermined fixed value, for example, 100 mmHg. If $\Delta Mn>100$ mmHg, the routine goes to step 205 and the counter CAC is cleared. Conversely, if $\Delta Mn\leqq 100$ mmHg, the routine goes to step 208 and it is determined whether or not the engine speed NE is lower than a predetermined fixed value, for example, 3000 r.p.m. If $NE>3000$ r.p.m, the routine goes to step 205 and the counter CAC is cleared. Conversely, if $NE\leqq 3000$ r.p.m, the routine goes to step 209. Namely, the routine goes step 209 when 20 mmHg$\leqq\Delta Mn\leqq$100 mmHg and when $NE\leqq 3000$ r.p.m, and in step 209 it is determined whether or not the air-fuel mixture fed into the engine cylinder is lean or rich. If the air-fuel mixture is lean, the routine goes to step 210, and the count value of the counter CAC is incremented by one. Then the routine goes to step 212. Conversely, if the air-fuel mixture is not lean, i.e., is rich, the routine goes to step 211 and the count value of the counter CAC is decremented by one. Then the routine to step 212.

FIGS. 8(*a*)-(*j*) illustrate changes in ΔMn and the count value of the counter CAC at the time of acceleration. FIGS. 8(*a*)-(*e*) indicate the gentle accelerating operation wherein the engine speed NE gently becomes high, and FIGS. 8(*f*)-(*j*) indicates the abrupt accelerating operation wherein the en becomes high.

Referring to FIGS. 8(*a*)-(*e*) indicating the gentle accelerating operation, since the absolute pressure PM in the surge tank 11 gently becomes high, the blunt value Mn of the absolute pressure PM also gently becomes high, following the increase in the absolute pressure PM. Consequently, when the gentle accelerating operation is started, although ΔMn immediately becomes higher than 20 mmHg it does not exceeds 100 mmHg. In addition, at this time, since the engine speed NE is lower than 3000 mmHg, the count up operation or the count down operation of the counter CAC is carried out for almost the entire time of the gentle accelerating operation.

Conversely, when the abrupt accelerating operation is carried out as illustrated in FIGS. 8(*f*)-(*j*), since the absolute pressure PM in the surge tank 11 abruptly becomes high, the blunt value Mn of the absolute pressure PM cannot follow the increase in the absolute pressure PM in the first half of the acceleration, but gradually approaches the absolute pressure PM in the latter half of the acceleration. Namely, in the first half of the acceleration, although ΔMn temporarily becomes within 20 mmHg$\leqq\Delta Mn\leqq$100 mmHg it immediately exceeds 100 mmHg, and accordingly, in the first half of the acceleration the count up operation or count down operation of the counter CAC cannot be substantially carried out. On the other hand, in the latter half of the acceleration, since ΔMn becomes lower than 100 mmHg, the count up operation or count down operation of the counter CAC is started. Consequently, the time during which the counter CAC is counted up or down at the time of gentle accelerating operation becomes longer, and the time during which the counter CAC is counted up or down at the time of the abrupt accelerating operation becomes shorter. Namely, the time during which the counter CAC is counted up or down becomes shorter as the degree of the acceleration becomes higher.

When 20 mmHg$\leqq\Delta Mn\leqq$100 mmHg, and when $NE\leqq 3000$ r.p.m, if the air-fuel mixture becomes lean the count CaC is counted up, and if the air-fuel mixture becomes rich the counter CAC is counted down. At this time, since an increasing rate of the engine speed NE is increased as the degree of the acceleration becomes larger, an increasing rate or a reducing rate of the count value of the counter CAC is increased as the degree of the acceleration becomes larger.

Turning to FIG. 10, in step 212 it is determined whether or not the count value of the counter CAC is larger than a predetermined positive fixed value A. If $CAC<A$, the routine jumps to step 215 and it is determined whether or not the count value of the counter CAC is smaller than a predetermined negative fixed value B. If $CAC<B$, the routine goes to the routine for calculating the fuel injection time.

Conversely, if it is determined in step 212 that the count value of the counter CAC is larger than A, the routine goes to step 213 and a predetermined fixed value, for example, 0.05, is added to the correction coefficient KAC. Then in step 214 the counter CAC is cleared. If it is determined in step 115 that the count value of the counter CAC is smaller than B, the routine goes to step 216 and a predetermined fixed value, for example, 0.05, is subtracted from the correction coefficient KAC. Then in step 217 the counter CAC is cleared.

When the gentle accelerating operation is carried out as illustrated in FIGS. 8(*a*)–(*e*), and when the abrupt accelerating operation is carried out as illustrated in FIGS. 8(*f*)–(*j*), if the air-fuel mixture is at the same lean state, the count value of the counter CAC is increased to almost the same value. Consequently, it is possible to correctly detect the lean state of the air-fuel mixture, regardless of the degree of the acceleration, and thus the correction coefficient KAC is properly increased.

Figure 11:
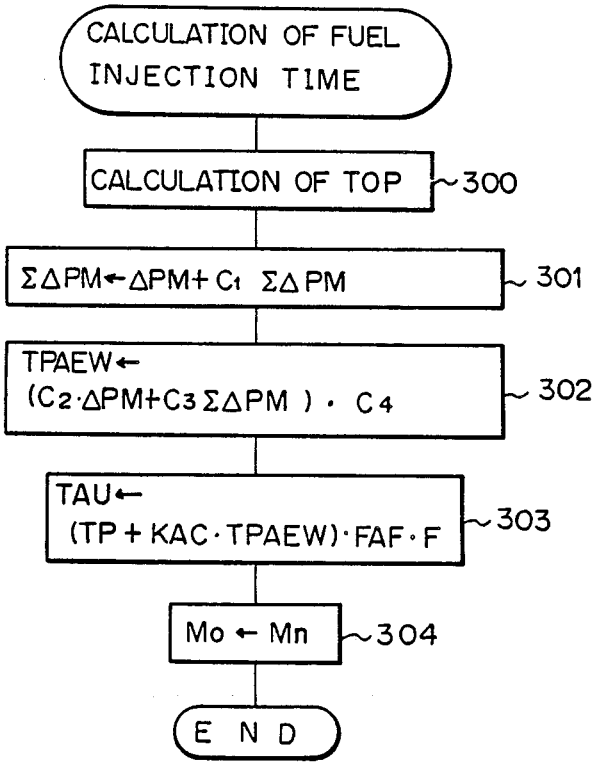
FIG. 11 is a flow chart for calculating the fuel injection time.

FIG. 11 illustrates a routine for calculating the fuel injection time, which routine is executed successively after the execution of the routine illustrated in FIGS. 9 and 10.

Referring to FIG. 11, in step 300 the basic fuel injection time TP is calculated from the output signals of the absolute pressure sensor 21 and the engine speed sensor 23. Then, in step 301 ΣΔPM is calculated from the following equation.

$$\Sigma\Delta PM=\Delta PM+C_1\Sigma\Delta PM \quad (5)$$

Then in step 302 the correction fuel injection time TPAEW is calculated from the following equation.

$$TPAEW=(C_2.\Delta PM+C_3.\Sigma\Delta PM).C_4 \quad (6)$$

If the above equations (5) and (6) are combined, the resulting equation becomes as follows.

$$TPAEW=\{C_2.\Delta PM+C_3.(\Delta PM+C_1\Sigma\Delta PM)\}.C_4$$

This equation represents the above-mentioned equation (3), and thus represent an increase or a reduction in the amount of fuel necessary to maintain the air-fuel ratio of the mixture at the stoichiometric air-fuel ratio in a transition operating state where a deposit is not adhered to the inner wall of the intake port, etc.

Then, in step 303, the fuel injection time TAU is calculated from the following equation.

$$TAU=(TP+KAC.TPEAW).FAF.F$$

If the air-fuel mixture becomes lean at the time of acceleration due to the presence of the deposit, the correction coefficient KAC is increased. Consequently, when the accelerating operation is carried out, since KAC.TPAEW, i.e., the acceleration increasing rate of the amount of fuel is increased, the air-fuel ratio of the mixture is maintained at the stoichiometric air-fuel ratio. In addition, if the correction coefficient KAC is increased, when the decelerating operation is carried out, since KAC.TPAEW, i.e., the deceleration reducing rate of the amount of fuel is increased, the air-fuel ratio of the mixture is maintained at the stoichiometric air-fuel ratio. Therefore, even if the deposit is adhered to the inner wall of the intake port, etc., it is possible to maintain the air-fuel ratio of mixture at the stoichiometric air-fuel ratio regardless of the operating state of the engine.

After the fuel injection time TAU is calculated in step 303, the blunt value Mn is memorized as Mo in step 304, and the correction coefficient KAC is stored in the back-up RAM 32*a*.

In addition, if the engine is raced, since the engine speed becomes high more rapidly than when the abrupt accelerating operation is carried out, if the counter CAC is operated at this time, this causes a wrong determination that the air-fuel mixture is lean, even though the actual air-fuel mixture is not lean. Consequently, when the engine speed exceeds 3000 r.p.m, the control of the deposit learning coefficient is stopped to eliminate a wrong learning of the deposit learning coefficient.

Figure 12:
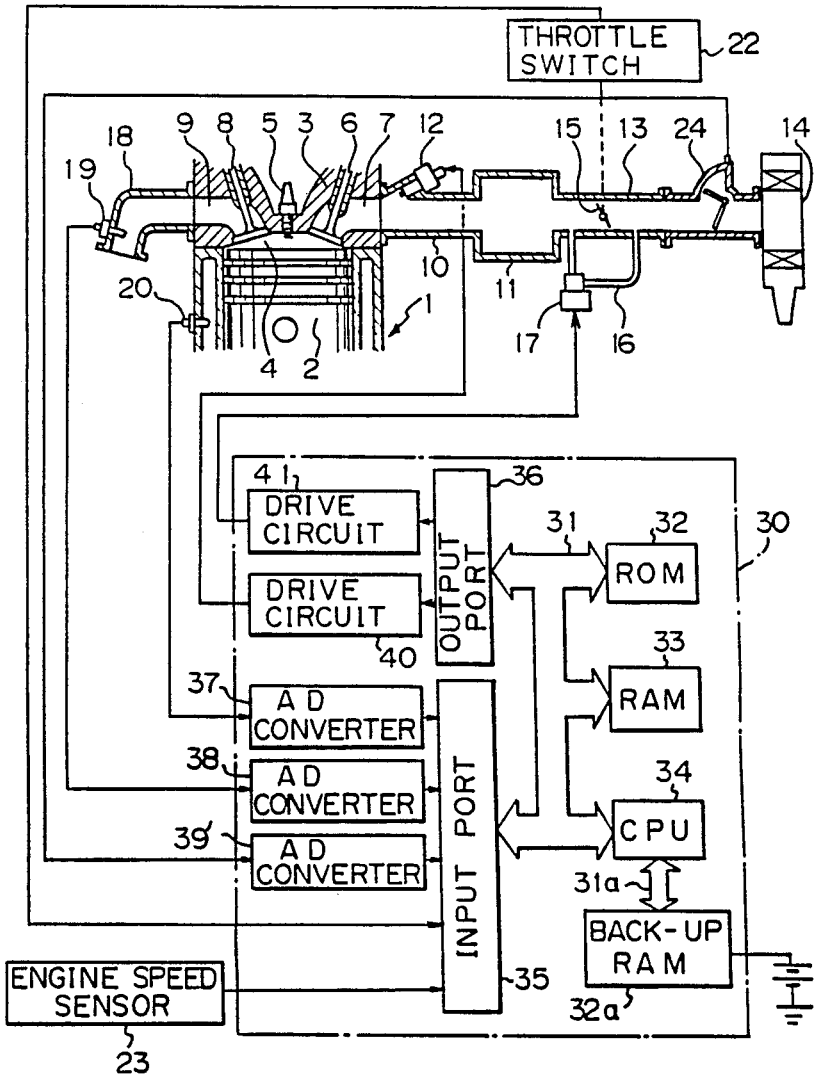
FIG. 12 is a schematically illustrated view of an alternative embodiment of an engine.

FIGS. 13 through 16 illustrate an alternative embodiment of the invention, and FIG. 12 illustrates an engine in the same manner as illustrated in FIG. 1. Accordingly, in FIG. 12, similar components are indicated by same reference numerals as used in FIG. 1.

Figure 13:
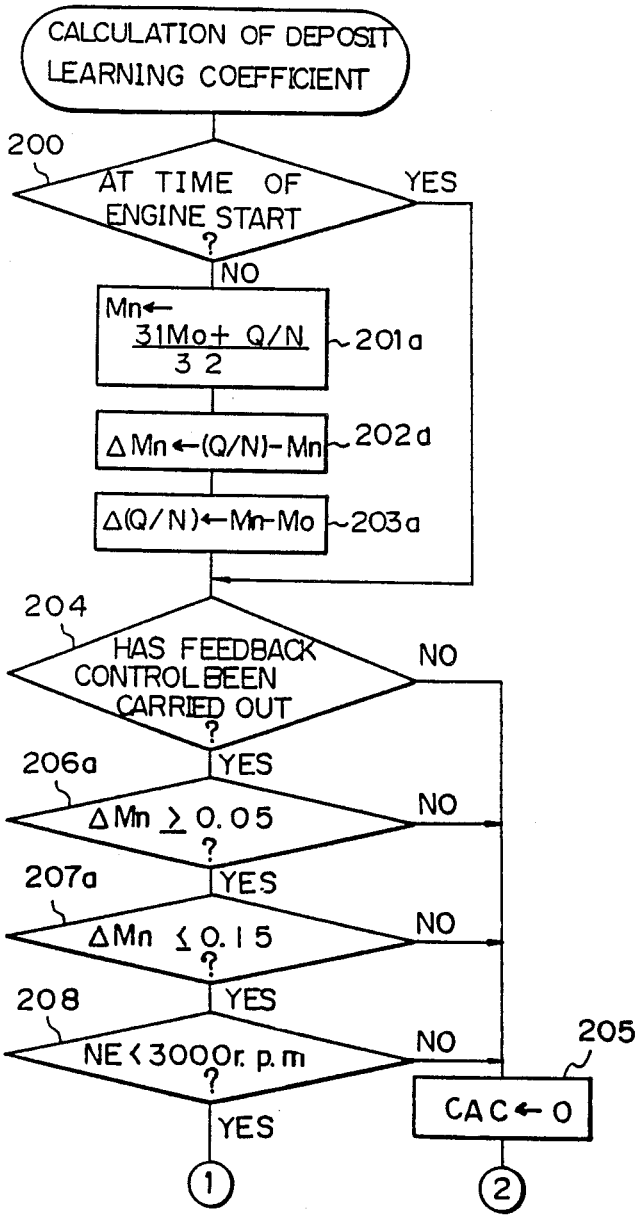
FIGS. 13 and 14 are a flow chart for calculating the deposit learning coefficient used in the engine illustrated in FIG. 12.

Referring to FIG. 13, an air flow meter 24 is provided between the intake duct 13 and the air cleaner 14. This air flow meter 24 produces an output voltage proportional to the amount of air fed into the engine cylinder, and this output voltage is input to the input port 35 via an AD converter 39'.

Figure 14:
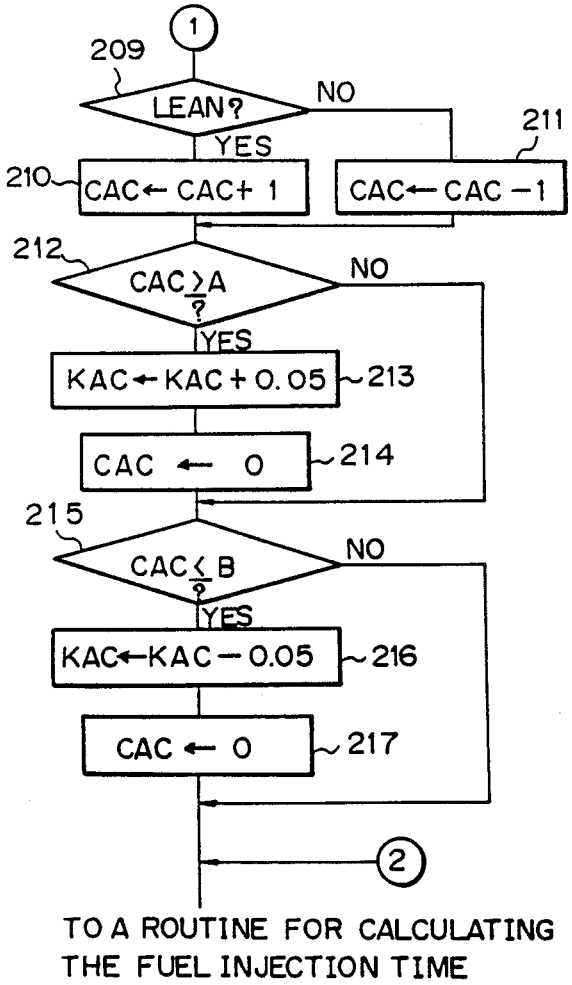
Figure 15:
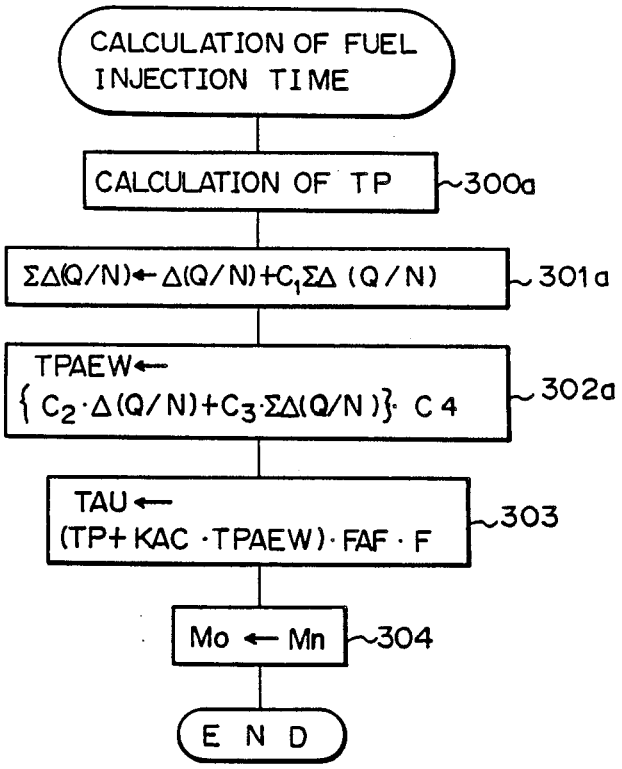
FIG. 15 is a flow chart for calculating the fuel injection time.

FIGS. 13 and 14 illustrate a routine for calculating the deposit learning coefficient used for the engine shown in FIG. 12, and FIG. 15 illustrates a routine for calculating the fuel injection time used for the engine shown in FIG. 12.

In the routine illustrated in FIGS. 13 and 14, similar steps are indicated by the same reference numerals used in the routine shown in FIGS. 9 and 10.

Referring to FIGS. 13 and 14, in step 201*a*, Q (amount of air fed into the engine cylinder)/N (engine speed) is calculated from the output signals of the air flow meter 24 and the engine speed sensor 23, and the blunt value Mn is calculated by this Q/N. This Q/N represents the amount of air fed into the engine cylinder per one revolution of the engine, and thus Q/N represents the engine load. The absolute pressure PM in the surge tank 11 also represents the engine load, and thus both Q/N and PM represent the engine load. Consequently, in the routine illustrated in FIGS. 13 and 14, Q/N is used instead of PM, and ΔQ/N is used instead of ΔPM. A suffix a is added to the reference numerals of steps in which Q/N and ΔQ/N are used instead of PM and ΔPM, respectively. Note, 0.5 in step 206*a* is a fixed value corresponding to 20 mmHg in step 206 of FIG. 9, and 0.15 in step 207*a* is a fixed value corresponding to 100 mmHg in step 207 of FIG. 9. In steps 200 to 217 of FIGS. 13 and 14, a similar calculation is carried out as in steps 200 to 217 of FIGS. 9 and 10, and therefore, a description of steps 220 to 217 is omitted.

Referring to FIG. 15, in step 300*a* the basic fuel injection time TP is calculated on the basis of the engine speed N and the amount of air Q fed into the engine cylinder. In steps 301*a* and 302*a*, Δ(Q/N) is merely used instead of ΔPM as in steps 301 and 302 of FIG. 11, and steps 303 and 304 in FIG. 15 are the same as in FIG. 11. Consequently, a description of steps 301*a* to 304 is omitted.

Where the fuel injection time TAU is calculated on the basis of the output signal of the air flow meter 24, the following equation may be used instead of the equation used in step 303 of FIG. 15.

$$TAU=K.(Q/N).\{1+C.KAC.\Delta(Q/N)\}.FAF.F \quad (7)$$

where, K and C are constant.

If the above equation (7) is used it is not necessary to calculate the correction fuel injection time TPAEW.

Consequently, in this case, steps 301*a* and 302*a* are not necessary in the routine illustrated in FIG. 15.

According to the present invention, it is possible to correctly determine whether or not the air-fuel mixture is lean, regardless of the degree of the acceleration, and thus it is possible to maintain the air-fuel ratio at a desired air-fuel ratio regardless of the degree of acceleration.

While the invention has been described by reference to specific embodiments chosen for purposes of illustration, it should be apparent that numerous modifications could be made thereto those skilled in the art without departing from the basic concept and scope of the invention.

We claim:

1. A fuel injection control device of an engine having an intake passage and an exhaust passage, said device comprising:

an oxygen concentration detector arranged in the exhaust passage and producing an output signal indicating whether an air-fuel mixture fed into the engine is lean or rich;

feedback control means for controlling an amount of fuel fed into the engine in response to the output signal of said oxygen concentration detector to bring an air-fuel ratio of the mixture to a desired air-fuel ratio;

means for detecting an accelerating operation of the engine;

fuel increasing means for increasing the amount of fuel fed into the engine when the accelerating operation of the engine is carried out;

times calculation means determining, on the basis of the output signal of said oxygen concentration detector, whether the air-fuel mixture is lean or rich at a predetermined crankangle during a lean-rich discriminating time when the accelerating operation of the engine is carried out to calculate both times of being lean and times of being rich within said lean-rich discriminating time;

time control means for controlling said lean-rich discriminating time in response to a degree of an acceleration of the engine to shorten said lean-rich discriminating time as said degree of the acceleration of the engine becomes larger;

means for calculating a difference between said times of being lean and said times of being rich; and correction means for correcting an increase in the amount of fuel, which increase is caused by said fuel increasing means, to increase said increase in the amount of fuel when said times of being lean is larger than said times of being rich and when said difference is larger than a predetermined value, and to reduce said increase in the amount of fuel when said times of being rich is larger than said times of being lean and when said difference is larger than a predetermined value.

2. A fuel injection control device according to claim 1, wherein said degree of the acceleration is determined by a rate of change in an engine load L, and said time control means shortens said lean-rich discriminating time as the rate of the change in the engine load L becomes higher.

3. A fuel injection control device according to claim 2, wherein said engine load L is represented by an absolute pressure PM in the intake passage.

4. A fuel injection control device according to claim 2, wherein said engine load L is represented by Q/N, where Q indicates an amount of air fed into the engine and N indicates an engine speed.

5. A fuel injection control device according to claim 2, wherein said rate of the change in the engine load L is determined by a load difference between the engine load L and a blunt value Mn of the engine load L, which is obtained by blunting the change in the engine load L, and said lean-rich discriminating time is determined by said load difference.

6. A fuel injection control device according to claim 5, wherein said lean-rich discriminating time is a time during which said load difference is within a predetermined range.

7. A fuel injection control according to claim 5, wherein said engine load L is detected at a predetermined crankangle, and said blunt value Mn is calculated at a predetermined crankangle on the basis of said engine load L and a blunt value Mo which has been calculated before said blunt value Mn is calculated.

8. A fuel injection control device according to claim 7, wherein said blunt value Mn is represented by $(K.Mo+L)/(K+1)$, K is a positive integral number.

9. A fuel injection control device according to claim 7, wherein a calculation of said blunt value Mn is begun after the engine is started.

10. A fuel injection control device according to claim 1, wherein said times calculation means stops determining whether the air-fuel mixture is lean or rich in a predetermined operating state.

11. A fuel injection control device according to claim 10, wherein said predetermined operating state is a state wherein an engine speed exceeds a predetermined speed when the accelerating operation of the engine is carried out.

12. A fuel injection control device according to claim 10, wherein said predetermined operating state is a state wherein a feedback control by said feedback control means is not carried out.

13. A fuel injection control device according to claim 1, wherein said increase in the amount of fuel by said fuel increasing means is increased for a short time after the accelerating operation of the engine is started, and a reduction in said increase in the amount of fuel is begun after said short time has elapsed and continues after the accelerating operation of the engine is completed.

14. A fuel injection control device according to claim 13, wherein said increase in the amount of fuel is controlled on the basis of a rate of change in an engine load L, and said increase in the amount of fuel is increased when said rate of change is relatively high, said increase in the amount of fuel being reduced when said rate of change is relatively low.

15. A fuel injection control device according to claim 14, wherein said engine load L is represented by an absolute pressure PM in the intake passage.

16. A fuel injection control device according to claim 14, wherein said engine load L is represented by Q/N, where Q indicates an amount of air fed into the engine and N indicates an engine speed.

17. A fuel injection control device according to claim 14, wherein said rate of change in the engine load L is determined by a rate of change $\Delta L$ in a blunt value Mn of the engine load L, which is obtained by blunting the change in the engine load L.

18. A fuel injection control according to claim 17, wherein said engine load L is detected at a predetermined crankangle, and said blunt value Mn is calculated at a predetermined crankangle on the basis of said engine load L and a blunt value Mo which has been calculated before said blunt value Mn is calculated.

19. A fuel injection control device according to claim 18, wherein said blunt value Mn is represented by (K.Mo+L)/(K+1), where K is a positive integral number.

20. A fuel injection control device according to claim 17, wherein said increase in the amount of fuel is calculated from the following equation.

$$TPAEW=\{C_2.\Delta L+C_3.(\Delta L+C_1.\Sigma\Delta L)\}.C_4$$

where

TPAEW: said increase in the amount of fuel

ΔL: said rate of change in said blunt value $C_1$, $C_2$, $C_3$, $C_4$: coefficients.

21. A fuel injection control device according to claim 20, wherein said correction means corrects said TPAEW.

22. A fuel injection control device according to claim 20, further comprising: means for detecting a decelerating operation of the engine; fuel decreasing means for decreasing the amount of fuel fed into the engine when the decelerating operation of the engine is carried out; and correction means used during a deceleration operation for correcting an decrease in the amount of fuel, which decrease is caused by said fuel decreasing means, to increase said decrease in the amount of fuel when said times of being lean is larger than said times of being rich and when said difference is larger than a predetermined value, and to reduce said decrease in the amount of fuel when said times of being rich is larger than said times of being lean and when said difference is larger than a predetermined value, said decrease in the amount of fuel being also calculated from said TPAEW.

23. A fuel injection control device according to claim 22, wherein said correction means used during a deceleration operation corrects said TPAEW.

24. A fuel injection control device according to claim 20, wherein said increase in the amount of fuel is controlled by a rate of change ΔL in an engine load L, and is increased as said rate of change ΔL in the engine load L becomes higher.

25. A fuel injection control device according to claim 24, wherein said engine load L is represented by Q/N, where Q indicates an amount of air fed into the engine and N indicates an engine speed.

26. A fuel injection control device according to claim 24, wherein said increase in the amount of fuel is calculated by C.ΔL, where C is a coefficient.

27. A fuel injection control device according to claim 26, wherein said correction means corrects said C.ΔL.

28. A fuel injection control device according to claim 26, further comprising: means for detecting a decelerating operation of the engine; fuel decreasing means for decreasing the amount of fuel fed into the engine when the decelerating operation of the engine is carried out; and correction means used during a deceleration operation for correcting an decrease in the amount of fuel, which decrease is caused by said fuel decreasing means, to increase said decrease in the amount of fuel when said times of being lean is larger than said times of being rich and when said difference is larger than a predetermined value, and to reduce said decrease in the amount of fuel when said times of being rich is larger than said times of being lean and when said difference is larger than a predetermined value, said decrease in the amount of fuel being also calculated from said C.ΔL.

29. A fuel injection control device according to claim 28, wherein said correction means used during a deceleration operation corrects said C.ΔL.

* * * * *

UNITED STATES PATENT AND TRADEMARK OFFICE

CERTIFICATE OF CORRECTION

PATENT NO. : 4,976,242

DATED : December 11, 1990

INVENTOR(S) : Yukihiro SONODA, et al.

It is certified that error appears in the above-indentified patent and that said Letters Patent is hereby corrected as shown below:

Column 3, lines 39 and 42, change "is" to --are--;

Column 3, line 63, between "of" and "fuel" insert --liquid--.

Figure 6A:
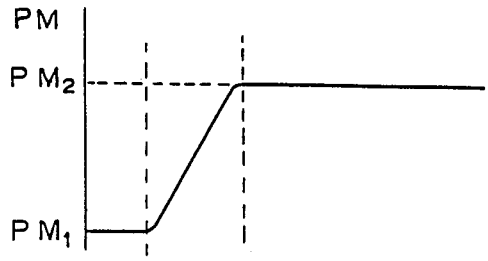
FIGS. 6(*a*)–(*c*) are diagrams illustrating the amount of fuel to be increased or decreased at the time of acceleration.
Figure 6B:
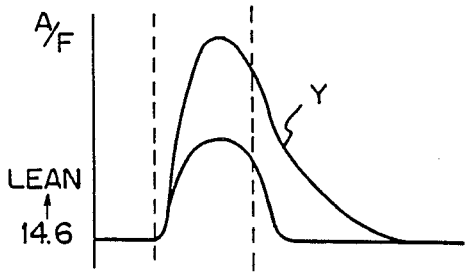
Figure 6C:
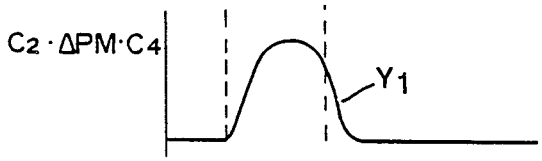
Figure 6D:
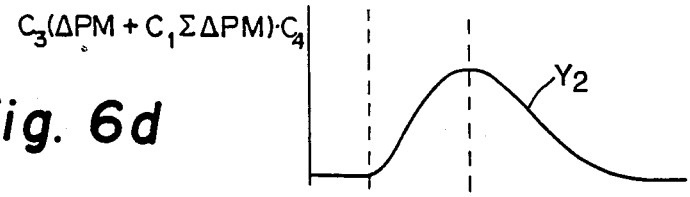
Figure 6E:
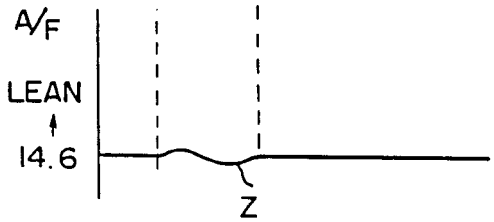
Figure 7A:
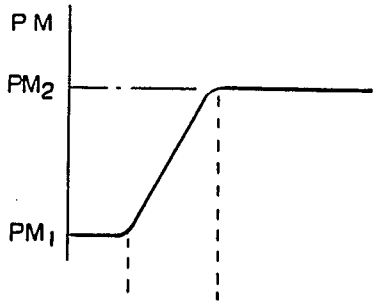
FIGS. 7(*a*)–(*f*) are diagrams illustrating the lean state and the rich state the air-fuel mixture.
Figure 7D:
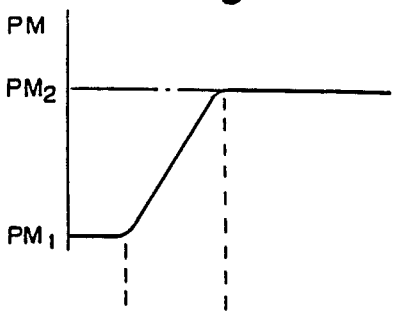
Figure 7B:
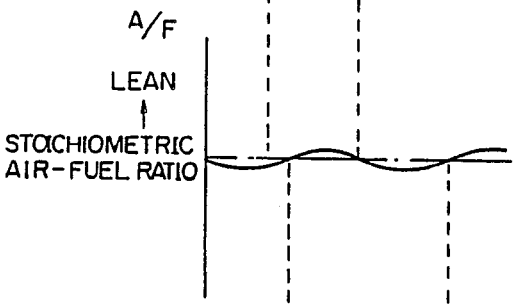
Figure 7E:
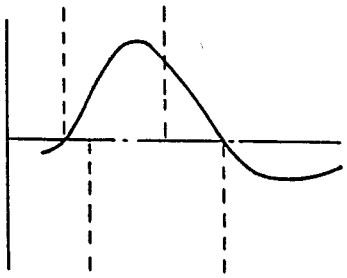
Figure 7C:
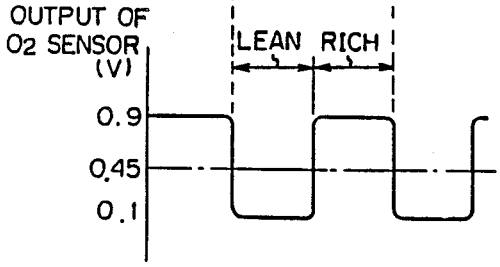
Figure 7F:
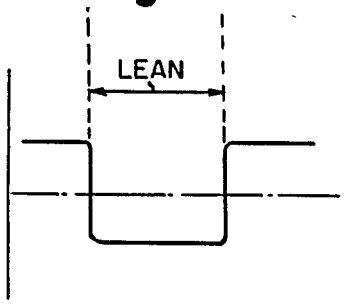

Column 3, line 64, change "FIGS. 6(a)-(c)" to --FIGS. 6(a)-(e)--.

Column 5, line 9, change "TAU=(TP+KAC.TPAEW).FAF.F" to --TAU=(TP+KAC·TPAEW)·FAF·F--.

Column 5, line 58, change "TAU=TP.FAF.F" to --TAU=TP·FAF·F--.

Column 6, line 37, change "TAU=TP.F" to --TAU=TP·F--.

Column 7, line 36, change "now with reference" to --now be described with reference--.

Column 7, line 36, change "illustrates" to --illustrate--.

Column 8, line 61, between "the" and "of" insert --time --.

UNITED STATES PATENT AND TRADEMARK OFFICE

CERTIFICATE OF CORRECTION

PATENT NO. : 4,976,242

DATED : December 11, 1990

INVENTOR(S) : Yukihiro SONODA, et al.

It is certified that error appears in the above-indentified patent and that said Letters Patent is hereby corrected as shown below:

Column 8, lines 66, change "$C_2.\Delta PM.C_4$" to --$C_2 \cdot \Delta PM \cdot C_4$--;

Column 9, line 1, between "$C_3.(\Delta PM+C_1.\Delta PM),C_4$" to --$C_3 \cdot (\Delta PM+C_1 \cdot \Delta PM),C_4$--.

Column 9, line 13, change "$\Delta PM.C_4$" to --$\Delta PM \cdot C_4$--.

Column 9, line 15, change "$C_2.\Delta PM.C_4$" --$C_2 \cdot \Delta PM \cdot C_4$--.

Column 9, line 20, 22, 24 and 25, change "$C_3.(\Delta P+C_1\Sigma\Delta PM).C_4$" to --$C_3 \cdot (\Delta P+C_1\Sigma\Delta PM) \cdot C_4$--.

Column 9, line 36, change "$C_2.\Delta PM.C_4$" and $C_3.(\Delta PM+C_1\Sigma\Delta PM).C_4$" to --$_{C2} \cdot \Delta PM \cdot C_4$ and $C_3 \cdot (\Delta PM+C_1\Sigma\Delta PM) \cdot C_4$--.

Column 9, line 44, change "$TPAEW=(C_2.\Delta PM+C_3.(\Delta PM+C_1\Sigma\Delta M).C_4$" to --$TPAEW=(C_2 \cdot \Delta PM+C_3 \cdot (\Delta PM+C_1\Sigma\Delta M).C_4$--.

Column 9, line 64, change "$TAU=(TP+TPAEW).FAF.F$" to --$TAU=(TP+TPAEW) \cdot FAF \cdot F$--.

UNITED STATES PATENT AND TRADEMARK OFFICE

CERTIFICATE OF CORRECTION

PATENT NO. : 4,976,242

DATED : December 11, 1990

INVENTOR(S) : Yukihiro SONODA, et al.

It is certified that error appears in the above-indentified patent and that said Letters Patent is hereby corrected as shown below:

Column 10, line 28, change "TAU=(TP+KAC.TPAEW).FAF.F" to --TAU=(TP+KAC·TPAEW)·FAF·F--;

Column 11, lines 29 and 30, change "valve" to --value--.

Column 12, line 5, change "indicates" to --indicate--.

Column 12, line 14, change "exceeds" to --exceed--.

Column 13, line 29, change "TPAEW=($C_2$.ΔPM+$C_3$.ΣΔPM).$C_4$" to --TPAEW=($C_2$·ΔPM+$C_3$·ΣΔPM)·$C_4$--.

Column 13, line 34, change "TPAEW=($C_2$.ΔPM+$C_3$.(ΔPM+$C_1$ΣΔPM).$C_4$" to --TPAEW=($C_2$·ΔPM+$C_3$·(ΔPM+$C_1$ΣΔPM)·$C_4$--.

Column 13, line 44, change "TAU=(TP+KAC.TPEAW).FAF.F" to --TAU=(TP+KAC·TPEAW)·FAF·F--.

Column 12, line 6, change "en between" to --engine speed NE abruptly becomes --.

UNITED STATES PATENT AND TRADEMARK OFFICE

CERTIFICATE OF CORRECTION

PATENT NO. : 4,976,242

DATED : December 11, 1990

INVENTOR(S) : Yukihiro SONODA, et al.

It is certified that error appears in the above-indentified patent and that said Letters Patent is hereby corrected as shown below:

Column 13, lines 50 and 55, change "KAC.TPAEW" to --KAC·TPAEW--;

Column 14, line 64, change "TAU=K.(Q/N).{1+C.KAC.Δ(Q/N}.FAF.F" to --TAU=K·(Q/N)·{1+C·KAC·Δ(Q/N}·FAF·F--.

Column 15, lines 51 and 55, change "is" to --are--.

Column 16, line 22, change "(K.Mo+L)/(K+1)," --(K·Mo+L)/(K+1),--.

Column 17, line 5, change "(K.Mo+L)/(K+1)." to --(K·Mo+L)/(K+1),--.

Column 17, line 11, change "TPAEW=($C_2$.ΔL+$C_3$.(ΔL)+$C_4$" to --TPAEW=($C_2$·ΔL+$C_3$·(ΔL)+$C_4$--.

Column 18, line 15, change "C.ΔL" --C·ΔL--.

Column 18, line 15, change "an" --a--.

UNITED STATES PATENT AND TRADEMARK OFFICE

CERTIFICATE OF CORRECTION

PATENT NO. : 4,976,242

DATED : December 11, 1990

INVENTOR(S) : Yukihiro SONODA, et al.

It is certified that error appears in the above-indentified patent and that said Letters Patent is hereby corrected as shown below:

Column 18, lines 27 and 30, change "is" to --are--;

Column 18, lines 33 and 36, Change "C.ΔL" --C·ΔL--.

Signed and Sealed this

Twenty-eighth Day of May, 1996

Bruce Lehman

*Attest:*

BRUCE LEHMAN

*Attesting Officer*

*Commissioner of Patents and Trademarks*